United States Patent [19]

Kemeny

[11] 4,426,562

[45] Jan. 17, 1984

[54] ROTARY SWITCH FOR SWITCHING VERY LARGE DC CURRENTS

[75] Inventor: George A. Kemeny, Wilkins Township, Allegheny County, Pa.

[73] Assignee: Westinghouse Electric Corp., Pittsburgh, Pa.

[21] Appl. No.: 309,289

[22] Filed: Oct. 6, 1981

[51] Int. Cl.[3] ..... H01H 33/06

[52] U.S. Cl. ..... 200/151; 200/8 A; 200/148 H; 200/150 C; 200/11 A

[58] Field of Search ..... 200/8 R, 8 A, 11 R, 200/DIG. 7, 151, 150 C, 148 H, 23, 24

[56] References Cited

U.S. PATENT DOCUMENTS

| | | | |
|---|---|---|---|
| 751,028 | 2/1904 | Thomson | 200/151 |
| 1,956,430 | 4/1934 | Turner | 200/8 A |
| 2,117,608 | 5/1938 | Hertzberg | 200/DIG. 7 |
| 2,245,763 | 6/1941 | Dewitz | 200/DIG. 7 |
| 2,908,789 | 10/1959 | Lange | 200/150 C |

FOREIGN PATENT DOCUMENTS

| | | | |
|---|---|---|---|
| 612712 | 5/1935 | Fed. Rep. of Germany | 200/148 H |
| 2818914 | 10/1979 | Fed. Rep. of Germany | 200/148 H |
| 534828 | 3/1941 | United Kingdom | 200/148 H |

*Primary Examiner*—Robert S. Macon
*Attorney, Agent, or Firm*—R. P. Lenart

[57] ABSTRACT

The cylindrical rotor of a switch for switching very large DC currents has a conducting element extending arcuately over a portion of its cylindrical surface and axially therealong. Two stationary brush members extend radially inward toward and axially along and are in sliding electrical contact with the cylindrical rotor surface. An arc chamber formed in the insulation between the brush members and extending arcuately around the rotor from one of the brush members accommodates the massive arc which is drawn as the rotor is rotated from a first position in which the conducting element shorts the brush members and conducts therebetween the very large current applied to the brush members and a second position in which contact between the rotor conducting element and the one brush member is broken. In one embodiment of the invention, the rotor conducting element shorts the second brush member to a third when the rotor is in the second position. In another embodiment of the invention, the first mentioned conducting element extends diametrically through the cylindrical rotor with additional conducting elements extending around the cylindrical surface on either side thereof. In this configuration, the additional conducting elements each short one of the brush members to an additional brush member when the rotor is in the second position and an arc chamber is also provided adjacent the second brush member.

28 Claims, 8 Drawing Figures

ROTARY SWITCH FOR SWITCHING VERY LARGE DC CURRENTS

BACKGROUND OF THE INVENTION

1. Field of the Invention

This invention relates to switches for interrupting and commutating very large DC currents and has particular application to switches used in switching the very large DC currents employed in the electromagnetic propulsion of projectiles.

2. Description of the Prior Art

When very large currents are interrupted or commutated into another circuit, massive arcs are created at the opening contacts. These arcs can do great damage and severely limit the useful life of switch contacts if not properly handled.

One application where very large DC currents must be switched is in electromagnetic propulsion of projectiles. In such an arrangement, a projectile is placed between two parallel, electrically conductive launcher rails. The electromagnetic forces generated by the injection into the launcher rails of a very large DC current, on the order of hundreds of thousands of amperes, drives the projectile down the rails and out of the muzzle at very high velocities, on the order of several thousand meters per second.

The very large DC current is injected into the launcher rails by a firing switch. Typically this firing switch has been a rail switch, which is actually a second parallel rail device with one of its rails connected to the breech end of each of the launcher rails with a nonconducting section inbetween. An armature, which is in sliding electrical contact with the switch rails, is driven down the switch rails by the electromagnetic forces generated by the very large DC current to be switched. When the armature passes the nonconducting section of the one switch rail, a massive arc is struck between the armature and the section of the one rail it is leaving. As the armature continues down the switch rails, the arc lengthens, thereby increasing arc voltage which results in the injection of the current into the launcher rails. When commutation of the current is completed, the arc is extinguished.

While the rail switch provides rapid commutation of the current into the launcher rails due to the high speed (on the order of 50 meters per second) of the switch armature at the time the arc is struck, it is bulky, expensive, and requires means for stopping the armature after commutation, for returning it to the starting point and for restraining it against the forces generated by the applied current preparatory to a second firing. Thus the rail switch is also not adequately suitable for burst, or rapid, firing of the rail launcher.

In one type of rail launcher arrangement, the very large DC current is provided by a kinetic energy device such as a homopolar generator which charges a large inductor. The inductor, which is connected in series with the homopolar generator and the firing switch, stores inductive energy and releases it into the launcher rails upon actuation of the firing switch. In such an arrangement, it is known to provide a power switch which isolates the homopolar generator while it is coming up to speed, then connects the generator to the inductor and firing switch for the firing sequence, and finally, when firing is completed, disconnects the generator while connecting the inductor across the firing switch to dissipate the charge remaining in the inductor.

Heretofore, this power switch has also been a rail switch with the attendant shortcomings discussed above (see my commonly owned copending application Ser. No. 207,568 filed Nov. 17, 1980). In a somewhat similar arrangement, a clamping switch in the form of conductive fingers which are rectilinearly inserted between bus bars has been used to short-circuit the homopolar generator during firing. This arrangement requires powerful hydraulic actuators to overcome the large electromagnetic forces resisting insertion of the conducting fingers.

The primary objective of the invention is to provide a switch for switching very large DC currents which is compact, is suitable for burst firing and does not require restraint of an armature preparatory to firing.

It is also an object of the invention to provide such a switch which is resistant to arc damage.

Other objects will become evident from a reading of the following summary of the invention and the description of the preferred embodiments.

SUMMARY OF THE INVENTION

In its broadest sense, the present invention relates to a switch for switching very large DC currents which includes a cylindrical rotor having a conducting element extending axially along and arcuately around a portion of the cylindrical surface of the rotor. It also includes at least two brush members which extend radially in toward and axially along the cylindrical surface of the rotor. The inner ends of the brush members have arcuate surfaces which are complementary to and are in sliding electrical contact with the cylindrical surface of the rotor. The arcuate surfaces of the brush members and the conducting element on the rotor are so dimensioned and angularly spaced apart that with the rotor in a first position, a very large DC current applied to one of the brush members flows from that brush member, through the conducting element on the rotor, and out through the other brush member. When the rotor is rotated to a second position, the conducting element is no longer in electrical contact with the brush member to which the very large DC current is applied, thereby interrupting the flow of this current from the one brush member to the other through the conducting element. This interruption of the flow of the very large DC current generates an arc between the one brush member and the conducting element as they separate. Fixed insulating members which surround the rotor between the brush members define an arc chamber for this arc extending around the rotor from that one brush member in the direction that the rotor turns in rotating from the first to the second position. In order to protect the switch from the damaging effects of this arc, arc resistant inserts are preferably provided along the axial edge of the one brush adjacent the arc chamber and along the axial edge of the conducting element which is last to break contact with the brush member.

The arc may be cooled to thereby raise its voltage and extinguish it sooner by providing the arc chamber with arc shutes in the form of grooves in the chamber walls extending in the direction of rotation of the rotor. Additionally, a cooling gas can be circulated through the arc chamber by way of passages through the fixed insulators and the brush member. A labyrinth seal can also be provided adjacent the arc chamber to preclude passage of the gases from the arc chamber around the rotor. Additional gas injected into the labyrinth seal through a passage in the fixed insulating means and withdrawn through the outlet passage in the arc chamber assures an even better seal. The flow of these gases can be synchronized with the rotation of the rotor so that they need only flow while the arcing occurs.

In one of the preferred embodiments of the invention, a third brush member is provided. This brush member is so dimensioned and located relative to the other brush members that, with the switch in the first position where the conducting element completes a circuit between the first and second brush members, no electrical contact is made between the conducting element and this third brush member. However, when the rotor is rotated to the second position to break contact with the first brush member, the conducting element completes an electrical circuit between the second and third brush members. As the rotor rotates from the first to the second position, the conducting element makes contact between the second and third brush members before it breaks contact between the first and second brush members.

The just-described embodiment of the invention is especially useful as the power switch in a rail launcher assembly. With the first brush member connected to the source of the very large DC current and the second brush member connected to the inductor, the first position of the switch rotor completes the circuit for charging the inductor and for firing. With the third brush member connected between the other side of the DC current source and the rail launcher firing switch, when the switch is rotated to the second position to connect the second and third brush members together after firing is completed, the DC source is removed from the circuit and the inductive energy is dissipated. Following this, the switch can be rotated to a third position in which none of the brush members are electrically connected to each other in the switch. This position can be used when the DC source is a homopolar generator while bringing the rotor up to speed. Since a very large DC current is only commutated in switching from the first to the second position of the rotor, an arc is only struck during this rotation of the switch and hence only the one arc chamber adjacent the first brush member is needed.

In another embodiment of the switch, the rotor is provided with three conducting elements. A first extends transversely through and axially along the rotor with radial ends terminating at angularly spaced locations on the cylindrical face of the rotor. Second and third conducting elements extend angularly around and axially along the cylindrical surface between the radial ends of the first conducting element on either side thereof. A stator includes four brush members extending radially inward toward the rotor. The brush members and the rotor conducting elements are so dimensioned and spaced that in a first position of the rotor the first conducting element completes a circuit between the first and second brush members, and in a second position the second conducting element completes a circuit between the first and third brush members while the third conducting element completes a circuit between the second and fourth brush members. The switch makes the contacts of the second rotor position before breaking those of the first position. With the very large DC current applied to the first and second brush members, massive arcs are drawn between these two members and the radial ends of the first conducting element as the rotor is rotated from the first to the second position. Accordingly, arc chambers extending axially along and arcuately around the rotor from both the first and second brush members in the direction of rotation of the rotor are provided in the fixed insulating member surrounding the rotor between the brush members. In the preferred form of this switch, the first conducting element extends diametrically through the rotor and the first and second brush members are located diametrically opposite one another. The third and fourth brush members may also be located diametrically opposite one another.

This second embodiment of the invention is especially useful as the firing switch in a rail launcher assembly. The first and second brush members are connected in series with the source of the very large DC current and the launcher rails are connected to the third and fourth brushes. In the first rotor position, the current passes straight through the switch, but as the switch is rotated to the second position, the current is injected into the launcher rails. Since in this configuration two arcs which are in series are drawn, arc voltage is doubled and commutation is accelerated. Another advantage of this arrangement is that when the switch is in the first position, the third and fourth brushes and, therefore, the launcher rails are completely isolated from the DC current. This eliminates the need for minimizing leakage current through the projectile or restraining the projectile prior to firing.

The rotary construction of the switch of this invention has several distinct advantages over the prior art rail switches. They are much more compact, they do not require reversal of direction of an armature to prepare for a second shot, thus they are much more suitable for burst firing, and they do not require restraint of the armature preparatory to a shot.

DESCRIPTION OF THE PREFERRED EMBODIMENT

Figure 1:
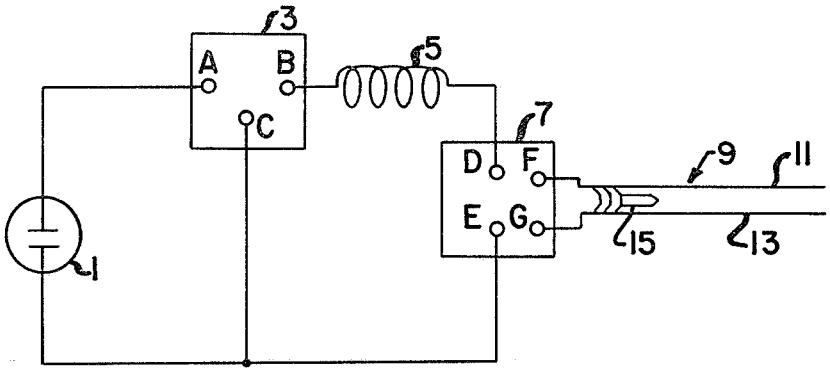
FIG. 1 is a schematic diagram of a parallel rail launcher firing system utilizing switches made in accordance with the teachings of this invention.

While the switches according to this invention are useful for switching very large DC currents in general, they will be described for illustrative purposes for switching the very large DC currents, on the order of several hundreds of thousands of amperes, employed in systems for the electromagnetic propulsion of projectiles. FIG. 1 illustrates such a system schematically in which a kinetic energy store such as a homopolar generator 1 is connected through a power switch 3 in series with an inductive energy storage device such as a large inductor 5 and a firing switch 7. The firing switch is connected to a parallel rail launcher 9 which includes a pair of parallel, conducting rails 11 and 13 and a projectile 15 in sliding contact with the rails.

The power switch 3 has three contacts: A, B and C. Contact A is connected to one side of the homopolar generator 1, contact B is connected to one side of the inductor 5, and the third contact C is connected between the other side of the homopolar generator and the firing switch 7. In a first position of switch 3, contacts A and B are shorted. In a second position, contacts B and C are shorted, and in a third position, no contact is made between any of the contacts. The firing switch 7 has four contacts: D, E, F and G. Contact D is connected to the other side of the inductor 5 and E is connected to the other side of the homopolar generator 1. Contacts F and G are connected to rails 11 and 13, respectively. The switch 7 has two operative positions. In the first, D is shorted to E to isolate the launcher rails, and in the second D is connected to F and E to G to introduce the launcher rails into the series circuit.

In operation, the switch 3 is placed in the third position in which all the contacts A, B and C are isolated while the homopolar machine 1 is being brought up to speed and while the system is on standby. At this point, the firing switch 7 is in its first position wherein the launcher rails are removed from the series circuit. In preparation for firing, the power switch 3 is operated to the first position which shorts contacts A and B and the inductor 5 is charged to the desired current magnitude. The launcher is now fired by operating the firing switch 7 to the second position to inject the very large DC current into the launcher rails 11 and 13. This current generates an electromagnetic field which drives the projectile down the rails and accelerates it to a very high velocity in a manner well known in the art. The projectile 15 can have a conducting portion through which the current passes or it may be electrically insulated from the rails, in which case an arc or plasma behind the projectile provides the acceleration.

The launcher may be fired once or burst fired. In either case, when firing is completed, the power switch 3 is operated to the second position which shorts B to C for dissipation of the stored inductive energy and for isolation of the homopolar generator.

Figure 2:
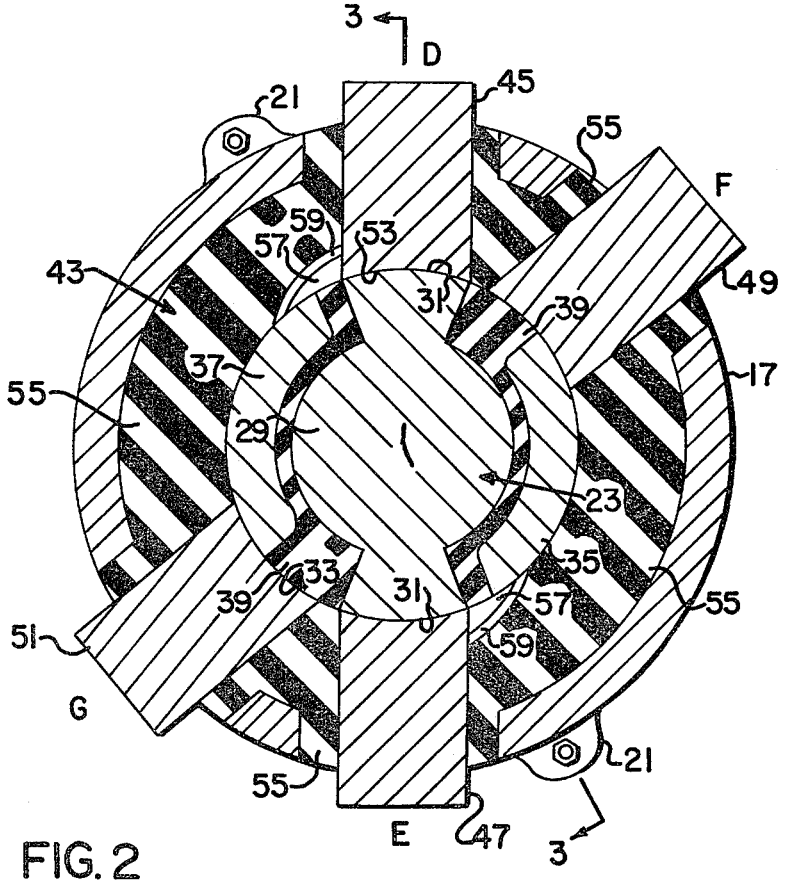
FIG. 2 is a vertical, transverse section through a switch according to one embodiment of the invention taken along the line 2—2 shown in FIG. 3.
Figure 3:
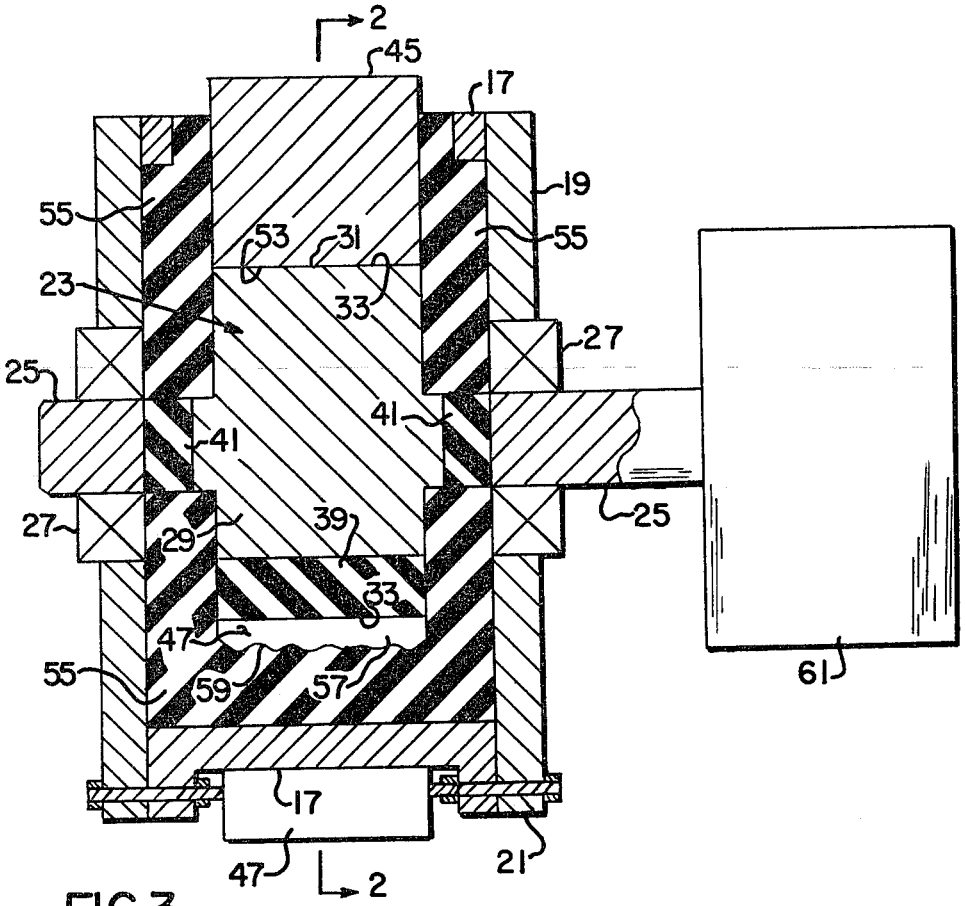
FIG. 3 is a vertical, longitudinal section through the switch of FIG. 2 taken along the line 3—3 shown in FIG. 2.
Figure 4:
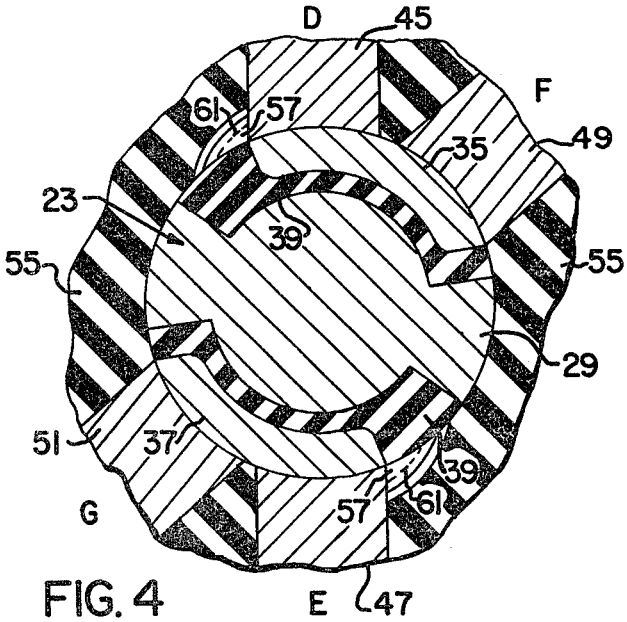
FIG. 4 is a vertical, transverse section similar to FIG. 2 but with the switch rotor in a second angular position.

A preferred form of the firing switch 7 is shown in FIGS. 2 through 4. This switch includes a cylindrical housing 17 with circular end plates 19 bolted to the housing through dog ear flanges 21. A cylindrical rotor 23 is mounted inside the housing for rotational movement with a shaft 25 which is journaled in bearings 27 in the end plates 19. The rotor 23 includes a first conducting element 29 which extends axially along and transversely through the rotor and terminates in arcuate end faces 31 in the cylindrical surface 33 of the rotor. While this conducting element 29 is shown as having in section a circular center portion with end portion 31 defined by radial side walls, the first conducting element may also comprise a bar-like conductor extending diametrically through the rotor.

The rotor also includes second and third conducting elements 35 and 37, respectively, extending axially along the rotor 23 and arcuately around the cylindrical surface 33 between the ends 32 of the first conducting element. Insulating members 39 extend axially along the rotor between the conducting elements to isolate them from direct electrical contact with one another. Additional insulators 41 isolate the shaft 25 from the first conducting element.

Between the rotor 23 and housing 17 is the stator 43 which includes diametrically opposed first and second brush members 45 and 47, respectively, extending axially along and radially inward toward the cylindrical surface 33 of the rotor. Similarly arranged third and fourth brush members 49 and 51, respectively, are angularly displaced about the rotor axis from the first and second brush members. These brush members all terminate at their inner ends in arcuate surfaces 53 which are complementary to and in sliding electrical contact with the cylindrical surface 33 of the rotor. The stator also includes insulating members 55 which surround the remainder of the rotor including the end faces to electrically isolate the brush members from direct electrical contact with one another and to insulate the rotor from the end plates 19. They also isolate the brush members from the housing 17.

The stator insulating members 55 define arc chambers 57 extending axially along and angularly around the rotor from the brush members 45 and 47 in the counterclockwise direction, the direction of rotation of the rotor 23. The radially outer walls of the arc chambers 55 are grooved as at 59 to form arc shutes shaped like slots or corrugations which provide additional surface area to cool the arc formed during switch operation as discussed below. Alternatively, the outer wall may have slots and separate insulating plates may be inserted into these slots and suitably held in place to form a deeply crenulated structure which will more rapidly cool the arc thereby accelerating extinction. Actually, the grooves or plates can be either parallel or transverse to the arc. The operative feature is that they increase the surface area to which the arc is exposed.

The brush members 45, 47, 49 and 51 correspond to the contacts D, E, F and G, respectively, discussed in connection with FIG. 1. Thus, FIGS. 2 and 3 illustrate the switch 7 with the rotor in the first position discussed above, that is, with the contacts D and E shorted by the first conducting element 29. In this position, the very large DC current passes directly through the switch. When the launcher is to be fired, the rotor 23 of the switch is rapidly rotated counterclockwise by a means such as a motor 61 attached to shaft 25. The dimensions and spacing of the conducting elements 29, 35 and 37 on the rotor and the brush members 45, 47, 49 and 51 are such that the second conducting element 35 will short the brush member 49 to 45 (contacts F and D), and third conducting element 37 will short brush member 51 to 47 (contacts G and E) before the first conducting element 29 breaks contact between brush members 45 and 47 (contacts D and E). Arcs are drawn in the two arc chambers 57 between brush members 45 and 47 and the first conducting element 29 as these parts separate resulting in commutation of the very large current into the rails 11 and 13 of rail switch 7 through the brush members 49 and 51 (contacts F and G, respectively). Since the two arcs are in series, the arc voltage is doubled which, in combination with the raising of the arc voltage through cooling by the arc shute formed by the grooved outer wall 59 of the arc chambers, results in more rapid extinguishment of the arc and, hence, more rapid commutation. Rapid commutation is important in minimizing arc damage to the brush members, rotor conducting elements and arc chambers, as well as in assuring a rapid rise in the projectile accelerating forces to their full value. After arc interruption, that is, after the current has been commutated, the switch rotor assumes the position shown in FIG. 4. The dotted lines 61 in this figure show where the arcs were initially drawn and interrupted. They are shown for illustrative purposes only since by the time the rotor has reached the position shown in FIG. 4, commutation has, of course, been completed.

In order to estimate the size of the rotor 23, its weight, the forces required to rotate it, etc., an arcuate contact length for the brush members 45, 47, 49 and 51 is arbitrarily selected to be four inches. A peripheral velocity at arc start of 165 ft/sec (50 m/sec) is chosen since this velocity has proven satisfactory in the rail type firing switches mentioned earlier. A maximum current density of 62.5 KA/in$^2$ is chosen for similar reasons. Assuming a maximum current of 1.5 million amperes, 24 in$^2$ of brush contact area is required and, hence, the rotor requires an axial length of about 6 inches. Based upon the angle subtended by the brush members' arcuate length of 4 inches, the rotor 23 will be about 10.8 inches in diameter and, if made of aluminum, will weigh about 54 pounds. Maximum velocity at arc start will be required after a rotation of about 40 degrees and this will require a torque of about 16,000 lbf-ft for acceleration and, if we assume deceleration during another 40 degrees of rotation, a similar decelerating torque is required. If we assume the torque is supplied through two diametrically located rotational forces each applied one foot from the center of rotation, this will require individual accelerating and oppositely directed decelerating forces of 8,000 lbf which, though high, are readily attained. The maximum kinetic energy of the rotor will be about 11,200 ft-lbf (15.2 kilojoules) and if we assume, for example, an initial kinetic energy store of 15 megajoules for the complete firing of a projectile, or a burst of projectiles, then the switch rotor kinetic energy represents only a negligible 0.1% of the initial energy storage. Depending upon the switch accelerating and decelerating provisions, after firing system energy is dissipated, the rotor is finally turned either about 100 degrees or about 280 degrees to bring it back to the position shown in FIG. 2 for the next charging and firing sequence.

The above approximate calculations were made only to determine that the required switching can be performed by reasonably sized equipment and that the exertion of reasonable forces results in sufficiently high switch contact separation velocities. The calculations should be considered only as estimates because brush contact friction, the inertia of any lever arms and current induced forces due to the current paths through the switch parts themselves and due to interaction of current flow through the switch with current flow through exterior busses were all neglected.

Based on the above discussion, the brush members may be bar-shaped with a large cross-sectional area. During the rapid, transient current changes which occur during switching, such a large conductor cross-section will result in a very uneven current distribution in the brush member and this will, in turn, result in more transient voltage drop, more heating and undesired and deleterious nonuniform current density in the resilient electrical contacts. This may be alleviated by using a multiple-strand and preferably transposed brush body structure, similar to the way electrical high current cables are stranded and transposed.

Figure 5A:
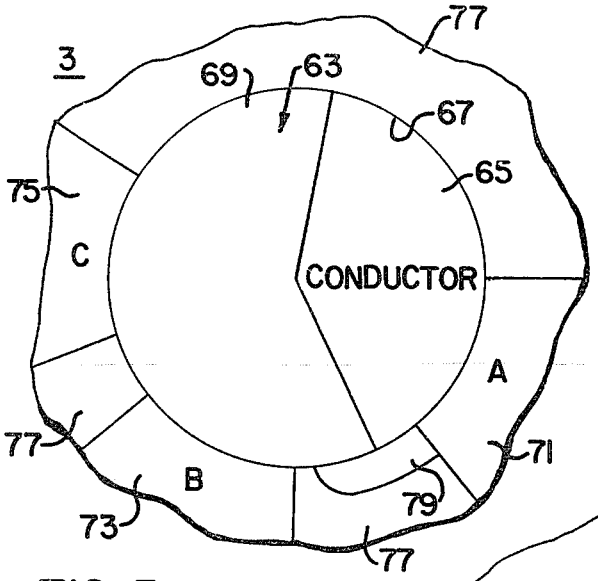
FIGS. 5*a*, 5*b* and 5*c* are schematic drawings of a second embodiment of a switch made in accordance with the invention, showing the switch rotor in three successive angular positions.
Figure 5B:
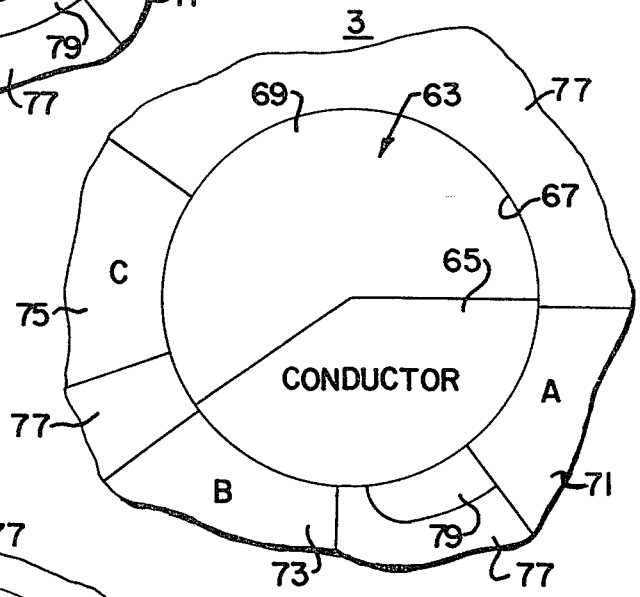
Figure 5C:
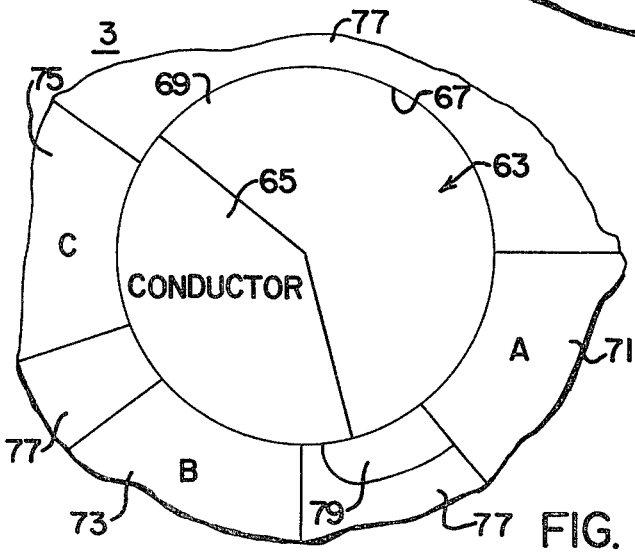

Another embodiment of the invention suitable for use as the power switch 3 in the circuit of FIG. 1 is shown schematically in FIGS. 5*a*, 5*b*, and 5*c*. In this switch, the rotor 63 has one conducting element 65 which extends axially along and angularly around a portion of the cylindrical surface 67 of the rotor. The remaining portion 69 of the cylindrical rotor is an insulating member. Three brush members 71, 73 and 75 corresponding to the contacts A, B and C of FIG. 1 extend axially along and radially inward toward the cylindrical surfaces 67 and are in sliding electrical contact therewith. Insulating members 77 surround the remainder of the rotor and electrically isolate the brushes from direct electrical contact with one another. An arc chamber 79 formed in the insulating member 77 extends arcuately around the rotor from the brush member 71 toward brush member 73.

FIG. 5*a* illustrates the power switch 3 in the aforementioned third position in which the conducting element 65 does not connect any two of the contacts A, B or C together. This is the position that is used when bringing the homopolar generator up to speed and preparatory to firing. When firing is to commence, the rotor 63 is rotated clockwise to the previously discussed first position shown in FIG. 5*b* wherein the conducting element 65 shorts brush members 71 and 73 (contacts A and B). This position is used for charging the inductor 5 and for injecting the very large DC current into the launcher rails through operation of the firing switch 7.

When the firing sequence is completed, the power switch 3 is rotated clockwise to the above-referenced second position shown in FIG. 5*c* wherein the conducting element 65 shorts brush members 73 and 75 (contacts B and C). In rotating from the position shown in FIG. 5*b* to that shown in FIG. 5*c*, the conducting element 65 makes the new circuit between contacts B and C before breaking the circuit between contacts A and B. As the contact area between conducting element 65 and brush member 71 separates, an arc is struck in arc chamber 79 which finally interrupts the current flow through member 71 with current now flowing between brush members 73 and 75 until the inductive energy stored in inductor coil 5 is dissipated. As discussed above in connection with the firing switch of FIGS. 2 through 4, the arc chamber 79 may be provided with arc shute-like structures (not shown) which cool the arc and accelerate commutation.

When the inductive energy stored in the inductor is dissipated in the firing circuit, the switch 3 is rotated clockwise from the second position shown in FIG. 5*c* back to the third position shown in FIG. 5*a*. Rather than stopping at the second position until the inductive energy is dissipated, the rotor 63 may be turned continuously but relatively slowly so that contacts B and C remain shorted for the time required for current decay. It should be observed that in turning the rotor from the second to third position, contact A remains insulated from contacts B and C and thus no undesired current can flow independently of whether the brushes on the homopolar generator are lifted or not. It should also be noted that the switch rotor is returned to the starting position without having to reverse direction which is an important advantage over the parallel rail switches presently suggested for use as the power switch.

It has so far been illustrated that rotating type switches can be built in a reasonable size even for very high pulse currents and that the desired switching sequences can be readily attained by suitable switch geometries involving the location and sizes of brushes and the interconnection and location of conducting and insulating rotor peripheral surfaces. In the switch of FIGS. 2 through 4, arc interruption is obtained by two series arcs which helps to rapidly commutate current into the barrel rails while in the FIG. 5*a* configuration only a single arc is drawn, which is adequate because current is being interrupted in the low inductance kinetic energy storage loop which, after inductive energy is dissipated, can only develop in the order of 100 arc volts across switch contacts, that is, the kinetic energy store terminal voltage. If, however, higher arc voltages are required or desired, it is quite feasible to utilize additional switch rotor and brush assemblies, series connected electrically and all turned in unison so that when one or more series arcs are drawn in one commutating switch assembly, additional series arcs will about concurrently be drawn by the other commutating switch rotor(s) to yield in combination the desired higher arc voltage and after arc extinction, a higher voltage withstand capability. Even though rotary switch configurations have only been explained in detail for two particular switching duties, it should be understood that rotary switches can be designed for other applications and switching sequences.

Figure 6:
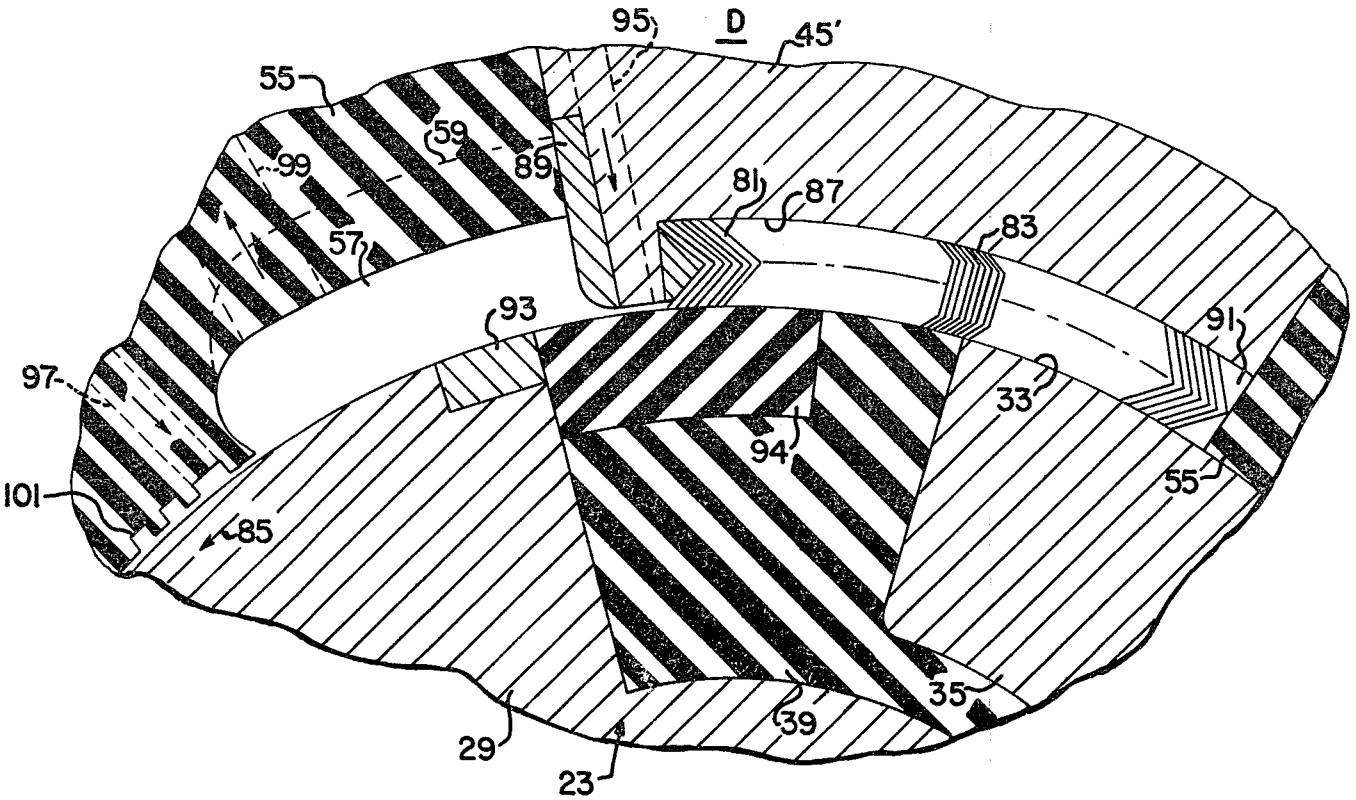
FIG. 6 is an enlarged sectional view of a portion of a switch such as that shown in FIGS. 2 through 4 illustrating alternative constructions of some of the switch details.

Additional aspects of this invention relate to special switch features which assure: successful conduction of the enormous pulse currents at all contact interfaces, arc interruption without excessive arc damage and repeated operation without requiring maintenance. FIG. 6 illustrates an enlarged portion of a switch, for example, the portion adjacent the brush member 45 (contact D) in the configuration of FIGS. 2 through 4 incorporating these special features.

As illustrated in FIG. 6, special electrical contacts are provided for conducting the very large currents between the rotor conducting elements and the brush members. The contact means are of multi-sheet, multi-finger design and two variations are illustrated for insertion into the annular volume existing between the solid metal conducting brush body 45' and the rotor surface 33. The "V" shaped design consists of thin sheet 81 bent as shown and of full switch rotor length each, for example, 6 inches for the previously calculated data. If these sheets were loose and closely stacked, there could be a tendency to be turned by the rotor and it is therefore more desirable to slightly space the sheets apart at their apexes and to join them there as this will yield flexibility at the electrical contact tips. When so joined, the contact structure is then an annularly shaped multi-finger surface. The multi-fingers are obtained by slotting the individual sheet edges with closely spaced cuts. The alternative contact sheet design 83 is similar except that the flexible contact portion is shorter which allows more space for joining the sheets by soldering, brazing, or bolting. The alternative design, assuming the sheets to be of uniform thickness, will require spacing means between the flat surfaces which can be obtained by inserting thin spacing sheets or by forming the sheets with suitable dimples or ridges to yield the required separation.

It should be observed that both multi-finger contact designs are directed so as to not impede rotor movement, which is counterclockwise in FIG. 6 as shown by arrow 85. Furthermore, the type of design illustrated will have the feature of increasing contact pressure with increasing current which is desired to reduce contact resistance and hence prevent contact overheating. Though the solid conducting brush body is shown bounded by radial planes, the brush body could also be bar-shaped, as shown for example in FIGS. 2 and 4, in which case the bar size would be about 4×6 inches which, for a good conductor and a fast pulse, may result in very nonuniform current distribution due to skin effects. This, in turn, could result in excessive local brush current densities and rapid brush failure due to overheating. This can be prevented by making the brush body with transposed conductors or using a somewhat lower conductivity bar which yields less skin effects or greater "penetration depth". Good low resistance electrical contact between the multi-finger structure and the brush body can then be assured by plating the bar contact surface 87, for example, with silver. Alternatively, the multi-finger structure may be directly joined to the brush body, for example, by soldering, to attain extremely low contact resistance. It should be appreciated that the multi-finger structure can be provided on the rotor conducting elements rather than on the brush members.

As shown at its left edge as seen in FIG. 6, the brush body 45' is furnished with an arc contact area or arc horn structure 89 made out of a suitably arc resistant material such as silver-tungsten. The arcing structure 89 can also serve as one end boundary or retainment for the annular multi-finger contact array 81 or 83; the other end confinement may be provided by an insulator 91 as the switching sequence at brush D in FIGS. 1 through 4 precludes arcing at this end. As shown in FIG. 6, the rotor surface may also include arc resistant, conducting inserts 93 in the conductor 29 and 94 in the adjacent insulating member 39.

The insulating structure 55 to the left of or counterclockwise from brush member 45', that is, on the arcing side, is provided with a suitably sized and vented arc chamber 57. The outer insulator peripheral wall should be of arc resistant material and may be smooth surfaced, or, as indicated by the dotted line, may utilize a deeply grooved surface 59 which will yield greater contact area between the arc or arcs and insulation, thus providing more arc cooling which, in turn, adds arc voltage and results in faster current commutation or arc interruption. For the configuration illustrated, electromagnetic forces will tend to force the arc against the stationary insulation surface which will result in higher arc voltages, thus improving switch performance. The circumferential length of the arc chamber 57 corresponds to about the maximum expected arc length. If desired, the switch configuration can easily accommodate a far longer arc chamber.

The insulation 55 will ablate during the arcing but by using suitable insulating material such as Teflon ®, for example, the ablated material will be primarily gaseous and thus not harmful to prolonged switch operation. Arc wear on the arc horn structures 89 and 93 will, however, result in metal deposition at undesired locations, which can eventually cause switch breakdown and excessive abrasive wear at the brush contact surface locations. Condensation of metal vapors at harmful locations can be impeded by properly directed gas flows, for example, by admitting gas through passages such as 95 and 97 and venting the gas through passage 99. Admitting gas at the location of passage 95 will have the further beneficial effect of lengthening the arc and thus increasing the arc voltage. Gas flow in undesired directions can be impeded by labyrinth seals 101. Gas flow during arc interruption can be triggered by entirely external means or the valving may be an integral part of the switch such as connected to shaft 25, for instance, so that at a given rotational position, gas flow will be automatically initiated. The gas should obviously be selected to yield good insulation and interruption performance. Sulfur hexafluoride or even air is suitable for these purposes.

If it is desired to operate the rotary switch at relatively high withstand voltages, for example 10 or more kilovolts, then operation with the working parts submerged in oil may prove very desirable. For this type of operation, the oil should preferably also be forced to enter through passages such as 95 and 97 and this may be done by external pressurizing means or may be self-induced by having pressure created in the arc chamber transmitted through passage 99 to a cavity which, in turn, forces fresh oil into passages 95 and 97. It should be observed that for the proposed electromagnetic launch applications such as the one illustrated in FIG. 1, the switch is only expected to attain a relatively low arc voltage of a few hundred volts and that the somewhat higher withstand voltage is only impressed across terminals after the arc is extinguished and the contacts have separated a reasonable distance, that is, after the projectile has attained a rather high velocity and current flows through a substantial length of the launcher rails.

During conduction at high current levels there will be large forces exerted against the contact faces of the solid brush bodies. It is assumed that during assembly, the annular contact finger arrays will be precompressed to yield acceptably low contact resistances and that additional forces generated at high currents will be transmitted to suitable support means.

In FIG. 6 it was assumed that the switch has to include means providing arc termination locations and suitable arc chamber structures. It should, however, be observed that brushes such as 73 and 75 (contacts B and C) in FIG. 5 will not be subjected to arcing in the intended mode of operation and therefore need not be furnished with arcing provisions. If a rotary switch structure were to be only used as a make switch, or a crowbar switch which closes at low voltage and never interrupts current, then such a switch need not have any arcing provisions at all.

In FIG. 6 the arc resistant insert 93 on the rotor was primarily provided to reduce arc damage on that rotor arc termination location. However, resistance aided commutation can greatly decrease the current level at the point where arcing is initiated, which, in turn, will enormously decrease arc chamber and arc contact area deterioration. Resistance aided commutation occurs when the voltage drop produced by the resistive insert causes some of the current to be already commutated into the new circuit, for example, into the rails 11 and 13 in FIG. 1, before arcing has started and, therefore, the current will be lower at the start of arcing and arcing will also generally persist for a shorter period of time, and both of these effects reduce switch deterioration. Resistance aided commutation can be obtained for the FIG. 6 configuration by making the rotor arc resistant insert 93 of a suitably higher resistance material and by also increasing its circumferential length or its conducting length to yield the desired resistance increase. These changes may, in turn, increase the required rotor circumference but the benefits of reduced arc damage are very likely to well justify a minor increase in switch size.

Finally, the performance of all switching equipment depends on using the device in a circuit matching its capabilities. For example, the FIG. 5 rotary switch configuration is primarily a make switch for ultra-high current which then interrupts a low inductance circuit which only develops a generator voltage of about 100 volts and hence, except for the high current capability, this switch duty is moderate. This switch 3 does not have to be subjected to any voltages higher than the arc voltage drop which it develops during interruption of current flow in the homopolar generator loop. The switching duty for the FIGS. 2 through 4 switch configuration is considerably more severe. This switch 7 must develop sufficient arc voltage so that the two series arcs between D and E will very rapidly commutate the total current into the closed breech loop DFGE before the projectile has moved an appreciable distance. It is therefore imperative that the added inductance of the breech loop DFGE be kept as low as possible which will require careful design of the switch and components exterior to the switch. After successful and complete commutation, the FIGS. 2 through 4 configuration will be subjected to a system voltage rising to one or more kilovolts across its terminals, that is, the breech voltage for the particular propulsion requirement. Thus this second application involves both higher arc voltages and higher withstand voltage and if the arc voltage is insufficient or not applied fast enough, commutation may not go to completion. Thus contact separation velocity is far more important in the FIGS. 2 through 4 system compared to the requirements of the FIG. 5 application.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A switch for switching very large DC currents comprising:

a cylindrical rotor having a first conducting element extending arcuately over at least one portion of the cylindrical surface of the rotor and axially therealong;

at least two angularly spaced stationary brush members extending radially inward toward and axially along the cylindrical surface of the rotor and terminating in arcuate surfaces complementary to and in sliding electrical contact with the cylindrical face of the rotor;

fixed insulating members extending between the brush members for electrically isolating the brush members from each other; and means for rotating said rotor;

said arcuate surfaces of the brush members and said first conducting element being so dimensioned and angularly spaced apart that with said rotor in a first position, said very large current flows from one of said brush members to which it is applied through said first conducting element and into the other brush member, and with said rotor rotated to a second position, said first conducting element is no longer in electrical contact with said one brush member, thereby interrupting the flow of said very large current from said one brush member to the other through said first conducting element and said fixed insulating member defining an arc chamber for the arc which is drawn upon the interruption of the flow of current from the one brush member to the first conducting element, said arc chamber extending angularly around said rotor from said first brush member in the direction that said rotor rotates in moving from said first to second positions.

2. The switch of claim 1 including arc resistant inserts in said one brush member extending axially along the edge thereof adjacent said arc chamber and in said first conducting element extending axially along the edge of said first conducting element which is last to break electrical contact with said one brush member.

3. The switch of claim 2 wherein at least one of the arc resistant inserts is also made of higher electrical resistivity material so that the thereby increased voltage drop produced by the current flow through said insert during switch rotation causes the current at arc initiation to be lower than it would be without the increased resistivity of the arc resistant material.

4. The switch of claim 1 wherein the surface of said fixed insulator defining the radially outward wall of the arc chamber is provided with a structure which increases the surface area to which the arc is exposed which aids in cooling said arc and expedites its extinction.

5. The switch of claim 1 or 4 including inlet and outlet passages connected to said arc chamber through which a cooling fluid is circulated through said chamber to cool and extinguish said arc.

6. The switch of claim 5 wherein the inlet passage is adjacent the one brush member and the outlet passage is adjacent the far end of the arc chamber such that the fluid flow tends to lengthen the arc to further raise the arc voltage and aid in extinguishing it.

7. The switch of claim 6 wherein said fixed insulating member defines a labyrinth seal facing the cylindrical surface of the rotor and extending axially therealong adjacent said far end of the arc chamber to preclude passage of fluids from the arc chamber around the rotor.

8. The switch of claim 7 wherein said fixed insulating member defines another passage communicating with the labyrinth seal through which fluid can be injected into the seal to be withdrawn with the arc chamber fluids through said outlet passage.

9. The switch of claim 1 including resilient, multipoint, electrical contacts of electrically conductive material between the arcuate surface of the brush members and the arcuate surface of the first conducting element.

10. The switch of claim 1 including resilient electrical contacts formed from bent sheets of resilient, electrically conductive material between the arcuate surfaces of the brush members and the arcuate surface of the first conducting element.

11. The switch of claim 10 wherein said resilient electrical contacts are mounted in the arcuate surfaces of said brush members.

12. The switch of claim 11 wherein said resilient electrical contacts are mounted in the arcuate surface of said first conducting element.

13. The switch of claim 1 including a third brush member extending radially inward toward and axially along the cylindrical surface of the rotor and terminating in an arcuate surface complementary to and in sliding electrical contact with the cylindrical face of the rotor with said fixed insulating member electrically isolating said third brush member from direct contact with the first two brush members, said third brush member being so dimensioned and angularly spaced from said other brush members that with said rotor in said first position said first conducting element is not in electrical contact with the third brush member, but with the rotor in said second position, said first conducting element is in electrical contact with both the other brush member and the third brush member to complete an electrical circuit therebetween.

14. The switch of claim 13 wherein said brush members are so dimensioned and angularly spaced that at an intermediate point as said rotor is rotated from said first position to the second position, said first conducting element is in electrical contact with all three brush members.

15. The switch of claim 1 wherein said first conducting element extends diametrically through said rotor and wherein said rotor includes second and third conducting elements, each of which extends angularly about the cylindrical surface of the rotor and axially therealong to one side of the first conducting element between the radial ends thereof, and rotor insulating members insulating said first, second and third conducting elements from direct electrical contact with each other, said switch also including third and fourth brush members extending radially inward toward, and axially along, the cylindrical surface of the rotor and terminating in arcuate surfaces complementary to, and in sliding electrical contact with, the cylindrical face of the rotor, said fixed insulating member isolating all of said brush members from direct electrical contact with each other, said conducting elements and brush members being so dimensioned and spaced that with the rotor in the first position, said first conducting element completes a circuit between the first and second brush members and no circuit is completed between either the third or fourth brush members and any other brush member and with the switch in said second position, said second conducting element completes an electrical circuit between the first and third brush members while the third conducting element completes an electrical circuit between the second and fourth brush members.

16. The switch of claim 15 wherein said fixed insulating member defines a second arc chamber extending angularly around said rotor from said second brush member in the direction that said rotor rotates in moving from said first to second position.

17. A switch for commutating a very large DC current into the spaced parallel rails of a launcher for electromagnetic propulsion of a projectile placed between the rails, said switch comprising:

(a) a cylindrical rotor including, a first conducting element extending transversely through and axially along the rotor with the radial ends thereof terminating at angularly spaced locations on the cylindrical surface of the rotor;

second and third conducting elements extending angularly around and axially along the cylindrical surface of said rotor between the radial ends of the first conducting element with one on either side thereof; and rotor insulating members electrically isolating said conducting elements from direct electrical contact with each other;

(b) a stator comprising, four brush members angularly spaced about the rotor and extending radially inward toward and axially along the cylindrical surface of the rotor, said brush members terminating in arcuate surfaces complementary to and in sliding electrical contact with the cylindrical surface of the rotor, said very large DC current being applied to first and second of said brush members which are angularly spaced by third and fourth of said brush members, each of which, in turn, is connected to one of said rails; and fixed insulating member surrounding the remainder of the rotor between the conducting elements for electrically isolating the same from direct electrical contact with each other; and (c) means for rapidly rotating said rotor from a first position in which said first conducting element completes a circuit between said first and second brush members and a second position in which the second conducting element completes a circuit between the first and third brush members and the third conducting element completes a circuit between the second and fourth brush members such that the very large DC current is commutated into the gun rails.

18. The switch of claim 17 wherein said fixed insulating members define arc chambers extending axially along and arcuately around said cylindrical rotor from the first and second brush members in the direction that said rotor rotates in moving from said first to second positions.

19. The switch of claim 17 in which the walls of said fixed insulating members defining said arc chambers are grooved to form arc shutes for cooling the arc formed as the very large DC current is commutated from the first conducting element into the parallel rails of the launcher.

20. The switch of claim 19 including inlet and outlet passages through the stator and communicating with the arc chambers for flowing a cooling fluid therethrough.

21. The switch of claims 17, 18 or 20 wherein said brush members and conducting elements are so dimensioned that as said rotor rotates from said first position to said second position, said second and third conducting elements make contact between the first and third and the second and fourth brush members, respectively, before said first conducting element breaks contact between the first and second brush members.

22. The switch of claim 21 wherein said first conducting element extends diametrically through said rotor and said first and second brush members are oriented diametrically opposite one another.

23. The switch of claim 22 wherein said second and fourth brush members are oriented diametrically opposite one another.

24. A switch for selectively inserting a source of a very large DC current into a series circuit including an inductor and the firing switch of an electromagnetic launcher, said switch comprising:

a cylindrical rotor including a conducting element extending angularly around a portion of and axially along the cylindrical surface of the rotor;

a stator including three angularly spaced brush members extending radially inward toward and axially along the cylindrical surface of the rotor and terminating in arcuate surfaces complementary to and in sliding electrical contact with the cylindrical surface of the rotor, a first of said brush members being connected to one side of the DC current source, a second of said brush members being connected to one side of the inductor and the third brush member being connected between the second side of the DC current source and said firing switch; and means for rapidly rotating said rotor between a first position in which the conducting element on said rotor completes an electrical circuit between said first and second brush members such that said DC current source is in series with the inductor and firing switch, and a second position in which said conducting element completes an electrical circuit between said second and third brush members such that said DC current source is removed from the series circuit.

25. The switch of claim 24 wherein said conducting element is so dimensioned and said brush members are so dimensioned and spaced that as said rotor is rotated by the rotating means from said first to second positions, the conducting element establishes electrical contact between the second and third brush members before electrical contact between the first and second electrical members is completely broken.

26. The switch of claim 25 wherein said stator includes fixed insulating members surrounding said rotor between said brush members and defining an arc chamber extending axially along and angularly around said cylindrical surface of the rotor from said first brush member in the direction of rotation of said rotor.

27. The switch of claim 26 in which the walls of said fixed insulating member defining said arc chamber are grooved in the direction extending angularly around the rotor to form arc shutes for cooling the arc formed as the very large current flowing from the DC current source to the inductor through the first brush member, the conducting element and the second brush member is interrupted.

28. The switch of claim 27 including an inlet and outlet passage through said stator and communicating with the arc chamber for flowing a cooling fluid therethrough.

* * * * *